US006913499B2

(12) United States Patent
Matsuda

(10) Patent No.: US 6,913,499 B2
(45) Date of Patent: Jul. 5, 2005

(54) EXHAUST PASSAGE OF SMALL WATERCRAFT, METHOD OF CONNECTING EXHAUST PIPE, AND WATER MUFFLER

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/637,944

(22) Filed: Aug. 7, 2003

(65) Prior Publication Data

US 2004/0063364 A1 Apr. 1, 2004

(30) Foreign Application Priority Data

Aug. 13, 2002 (JP) ..... 2002-235590
Jan. 24, 2003 (JP) ..... 2003-015724

(51) Int. Cl.[7] ..... B63H 21/32
(52) U.S. Cl. ..... 440/89 R; 440/89 C
(58) Field of Search ..... 440/89 R, 89 C, 440/89 F, 89 J

(56) References Cited

U.S. PATENT DOCUMENTS 5,016,439 A * 5/1991 Nitta ..... 60/310
6,461,208 B2 * 10/2002 Suzuki et al. ..... 440/89 R
6,739,921 B2 * 5/2004 Nakajima et al. ..... 440/89 F

* cited by examiner

*Primary Examiner*—Jesus D. Sotelo
(74) *Attorney, Agent, or Firm*—Alleman Hall McCoy Russell & Tuttle LLP

(57) ABSTRACT

An exhaust passage configured to discharge an exhaust gas from an engine of a small watercraft, comprises at least a first exhaust pipe, a second exhaust pipe connected to the first exhaust pipe, and a connecting structure configured to connect the first exhaust pipe and the second exhaust pipe to each other, the connecting structure including a first tubular insertion end portion provided at a connecting end portion of the first exhaust pipe so as to protrude toward a connecting end portion of the second exhaust pipe, a second tubular insertion end portion provided at the connecting end portion of the second exhaust pipe so as to accommodate the first tubular insertion end portion of the first exhaust pipe, a ring groove formed to extend circumferentially over an entire outer peripheral face of the first insertion end portion, and a seal ring configured to engage in the ring groove.

26 Claims, 12 Drawing Sheets

EXHAUST PASSAGE OF SMALL WATERCRAFT, METHOD OF CONNECTING EXHAUST PIPE, AND WATER MUFFLER

BACKGROUND OF THE INVENTION

1. Field of the Invention

The present invention relates to an exhaust passage of an exhaust gas (combustion gas) discharged from an exhaust port of an engine mounted in a small watercraft such as a personal watercraft (PWC), and a water muffler provided at a downstream portion of the exhaust passage in a flow of the exhaust gas.

2. Description of the Related Art

In recent years, jet-propulsion personal watercraft, which is one type of small watercraft, have been widely used in leisure, sport, rescue activities, and the like. The personal watercraft is configured to have a water jet pump that pressurizes and accelerates water sucked from a water intake generally provided on a bottom hull surface and ejects it rearward from an outlet port. As the resulting reaction, a body of the jet-propulsion personal watercraft is propelled. In the jet-propulsion personal watercraft, a steering nozzle provided behind the outlet port of the water jet pump is swung either to the right or to the left by operating a bar-type steering handle to the right or to the left, to change the ejection direction of the water to the right or to the left, thereby turning the watercraft to the right or to the left.

A first exhaust pipe fixed to the engine and a second exhaust pipe connected to the first pipe and including a muffler extending to muffle and discharge an exhaust gas from the engine outside the watercraft belong to different vibration systems, and are connected to each other through a rubber tube. However, since the rubber tube is exposed to a high temperature exhaust gas, durability of the rubber tube is reduced. Therefore, it is necessary to form a water supply hole in a portion upstream of a connecting portion of the exhaust pipes where the rubber tube is provided to allow a temperature of the exhaust gas to be reduced by supplying water to the exhaust gas. This is called "wet type." When the "wet type" is adopted in the connecting portion, water is reserved within the exhaust passage during a stopping state of the engine, while, during re-starting of the engine, the water within the exhaust passage might flow back toward a combustion chamber of the engine.

Since the personal watercraft is as short as approximately 3 to 4 m in total length, and the engine is located at substantially the center portion of the watercraft, the total length of the exhaust passage cannot be extended. In order to gain a peak output at a low engine speed of the engine in the personal watercraft having such a short exhaust passage, a water jacket is typically provided around the exhaust passage to allow a temperature of the exhaust gas to be reduced. In addition, water mist is supplied into the muffler to reduce the temperature of the exhaust gas for enhanced muffling effect. This is called "water muffler." However, during a stopping state of the engine, the water is reserved in the bottom portion of the water muffler and, during re-starting of the engine, the water reserved in the bottom portion might be suctioned toward the engine. Further, when the watercraft is inverted, the water outside the watercraft might enter the water muffler.

SUMMARY OF THE INVENTION

The present invention addresses the above described condition, and an object of the present invention is to provide a non-wet type exhaust passage having a portion where exhaust pipes belonging to different vibration systems are connected to each other. Another object of the present invention is to provide an exhaust passage in which the water reserved in a bottom portion of the water muffler is inhibited from flowing back toward the engine. Another object of the present invention is to provide a water muffler capable of inhibiting entry of the water from outside. A further object of the present invention is to provide a method of easily connecting a plurality of exhaust pipes.

According to the present invention, there is provided an exhaust passage configured to discharge an exhaust gas from an engine for driving a propulsion device of a small watercraft, comprising at least a first exhaust pipe; a second exhaust pipe connected to the first exhaust pipe; and a connecting structure configured to connect the first exhaust pipe and the second exhaust pipe to each other, the connecting structure including a first tubular insertion end portion provided at a connecting end portion of the first exhaust pipe so as to protrude toward a connecting end portion of the second exhaust pipe; a second tubular insertion end portion provided at the connecting end portion of the second exhaust pipe so as to accommodate the first tubular insertion end portion of the first exhaust pipe; a ring groove formed on an outer peripheral face of the first insertion end portion so as to extend circumferentially over an entire first insertion end portion; and a seal ring configured to engage in the ring groove such that the seal ring is biased to increase a diameter so as to allow sealing between an outer peripheral face of the seal ring and an inner peripheral face of the second insertion end portion of the second exhaust pipe.

In accordance with the exhaust passage of the small watercraft, the first insertion end portion of the first exhaust pipe and the second insertion end portion of the second exhaust pipe are connected to each other so as to be sealed with the seal ring provided between them. Since the outer peripheral face of the seal ring is biased to increase the diameter, a flexible structure is achieved in the connecting portion by compression of the seal ring. As a result, the first and second exhaust pipes are connected to each other in a sealed state and with flexibility. It follows that the first exhaust pipe and the second exhaust pipe belong to different vibration systems and keep their individual states.

The connecting structure may further include a durable sleeve member fitted to an inner peripheral face of the second insertion end portion of the second exhaust pipe so as to be in contact with the outer peripheral face of the seal ring to allow sealing between the sleeve member and the seal ring. In this structure, wear is less likely to be generated in the inner peripheral face of the second exhaust pipe because of the presence of the sleeve member. Even when the sleeve member is worn out, only this sleeve member is replaced.

The sleeve member may be tubular, and an end portion of the sleeve member on a connecting end side of the second exhaust pipe may have an inner diameter that gradually increases toward the connecting end. In this structure, while the first exhaust pipe is inserted into the second exhaust pipe, the seal ring smoothly slides into contact with the inner face of the sleeve member because of the increased-diameter portion of the sleeve member. This makes connection of the exhaust pipes easy, and consequently, productivity is increased.

At least one of the first and second exhaust pipes may have a water passage provided on a wall face thereof so as to communicate with the ring groove through an elongate hole to allow cooling water to be supplied to the ring groove. Since the cooling water lubricates the ring groove, wear of the seal ring and contact portions with the seal ring is avoided. In addition, the first and second exhaust pipes smoothly move relative to each other and are sealed tightly.

The seal ring may be made of shape-memory metal. When the exhaust pipes are connected to each other, the seal ring in a martensite state is pre-deformed to facilitate connection. After connection, the seal ring is heated, thereby restoring the deformed seal ring to its original shape, having proper seal ability. Therefore, the exhaust pipes are easily connected to each other and sealed reliably at the connecting portions.

An outer peripheral portion continuous with the first insertion end portion of the first exhaust pipe and located on an opposite side of a connecting end of the first insertion end portion, and an outer peripheral portion of the second insertion end portion of the second exhaust pipe may have a substantially equal diameter, and the connecting structure may further include a cover sleeve attached to the first exhaust pipe and the second exhaust pipe so as to substantially cover a connecting portion between the first insertion end portion and the second insertion end portion and a portion adjacent the connecting portion. The cover sleeve enhances the sealing effect. In addition, the cover sleeve allows the first exhaust pipe and the second exhaust pipe to have appropriate bending resistance.

The cover sleeve may be comprised of a flexible member, and the cover sleeve is fixed to the first and second exhaust pipes at both ends by using bands. Such a structure eliminates a gap between the cover sleeve and the outer periphery of the first exhaust pipe or the outer periphery of the second exhaust pipe.

According to the present invention, there is provided an exhaust passage configured to discharge an exhaust gas from an engine for driving a propulsion device of a small watercraft, comprising at least a first exhaust pipe; a second exhaust pipe connected to the first exhaust pipe; and a connecting structure configured to connect the first exhaust pipe and the second exhaust pipe to each other, the connecting structure including a first tubular insertion end portion provided at a connecting end portion of the first exhaust pipe so as to protrude toward a connecting end portion of the second exhaust pipe; a second tubular insertion end portion provided at the connecting end portion of the second exhaust pipe so as to accommodate the first tubular insertion end portion of the first exhaust pipe; a ring groove formed on an inner peripheral face of the second insertion end portion so as to extend circumferentially over the entire second insertion end portion; and a seal ring configured to engage in the ring groove such that the seal ring is biased to reduce a diameter so as to allow sealing between an inner peripheral face of the seal ring and an outer peripheral face of the first insertion end portion of the first exhaust pipe.

In accordance with the exhaust passage of the small watercraft, the first insertion end portion of the first exhaust pipe and the second insertion end portion of the second exhaust pipe are connected to each other in a sealed state with the seal ring provided between them. Since the inner peripheral face of the seal ring is biased to reduce the diameter, a flexible connecting structure is achieved by expansion of the seal ring. As a result, the first and second exhaust pipes are connected to each other in the sealed state and with flexibility.

The connecting structure may further include a durable sleeve member fitted to an outer peripheral face of the first insertion end portion so as to be in contact with the inner peripheral face of the seal ring to allow sealing between the sleeve member and the seal ring. In this structure, wear is less likely to be generated in the outer peripheral face of the first exhaust pipe because of the presence of the sleeve. And, when the sleeve member is worn out, only this sleeve member is replaced.

The sleeve member may be tubular, and an end portion of the sleeve member on a connecting end side of the first exhaust pipe may have an outer diameter that gradually reduces toward the connecting end. In this structure, while the first exhaust pipe is inserted into the second exhaust pipe, the seal ring smoothly slides into contact with the outer peripheral face of the sleeve member because of the increased-diameter portion of the sleeve member. This makes connecting work of the exhaust pipes easy and, consequently, productivity is increased.

At least one of the first exhaust pipe and the second exhaust pipe has a water passage provided in a wall thereof so as to communicate with the ring groove through an elongate hole to allow cooling water to be supplied into the ring groove. Since the cooling water lubricates the ring groove, wear of the seal ring and contact portions with the seal ring is avoided. In addition, the first and second exhaust pipes smoothly move relative to each other and are sealed closely.

The seal ring may be made of shape-memory metal. When the exhaust pipes are connected to each other, the seal ring in a martensite is pre-deformed to facilitate connection. After connection, the seal ring is heated, thereby restoring the deformed seal ring to its original shape having proper seal ability. Therefore, the exhaust pipes are easily connected to each other and sealed reliably at the connecting portions.

An outer peripheral portion continuous with the first insertion end portion of the first exhaust pipe and located on an opposite side of a connecting end of the first insertion end portion, and an outer peripheral portion of the second insertion end portion of the second exhaust pipe may have a substantially equal diameter, and the connecting structure may further include a cover sleeve attached to the first exhaust pipe and the second exhaust pipe so as to substantially cover a connecting portion between the first insertion end portion and the second insertion end portion and a portion adjacent to the connecting portion. The cover sleeve enhances the sealing effect. In addition, the cover sleeve allows the first exhaust pipe and the second exhaust pipe to have appropriate bending resistance.

The cover sleeve may be comprised of a flexible member, and the cover sleeve may be fixed to the first and second exhaust pipes at both ends by using bands. Such a structure eliminates a gap between the cover sleeve and the outer periphery of the first exhaust pipe or the outer periphery of the second exhaust pipe.

According to the present invention, there is further provided a method of connecting a first exhaust pipe and a second exhaust pipe, the first exhaust pipe and the second exhaust pipe forming an exhaust passage configured to discharge an exhaust gas from an engine for driving a propulsion device of a small watercraft and having insertion end portions to be connected to each other, the insertion end portion of the first exhaust pipe being configured to be accommodated in the insertion end portion of the second exhaust pipe, and the insertion end portion of the first exhaust pipe and the insertion end portion of the second exhaust pipe being sealed by elastic deformation of a radially and elastically deformable seal ring provided between the insertion end portion of the first exhaust pipe and the insertion end portion of the second exhaust pipe in a radial direction, the method comprising forming a ring groove on an outer peripheral face of the insertion end portion of the first exhaust pipe to extend circumferentially over the insertion end portion; engaging the seal ring in the ring groove and fixing the seal ring to the outer peripheral face of the insertion end portion by using combustible or heat-soluble fixing means so as to inhibit the seal ring from being elastically deformed to increase a diameter; inserting the insertion end portion of the first exhaust pipe into the insertion end portion of the second exhaust pipe; and heating the insertion end portions of the first and second exhaust pipes.

According to the present invention, there is further provided a method of connecting a first exhaust pipe and a second exhaust pipe, the first exhaust pipe and the second exhaust pipe forming an exhaust passage configured to discharge an exhaust gas from an engine for driving a propulsion device of a small watercraft and having insertion end portions to be connected to each other, the insertion end portion of the first exhaust pipe being configured to be accommodated in the insertion end portion of the second exhaust pipe, and the insertion end portion of the first exhaust pipe and the insertion end portion of the second exhaust pipe being sealed by elastic deformation of a radially and elastically deformable seal ring provided between the insertion end portion of the first exhaust pipe and the insertion end portion of the second exhaust pipe in a radial direction, the method comprising forming a ring groove on an inner peripheral face of the insertion end portion of the second exhaust pipe to extend circumferentially over the connecting end portion; engaging the seal ring in the ring groove and fixing the seal ring to the inner peripheral face of the insertion end portion by using combustible or heat-soluble fixing means so as to inhibit the seal ring from being elastically deformed to reduce a diameter; inserting the insertion end portion of the first exhaust pipe into the insertion end portion of the second exhaust pipe; and heating the insertion end portions of the first and second exhaust pipes.

In accordance with the above connecting methods, the seal ring is positioned in the ring groove and fixed to the outer peripheral face of the first exhaust pipe or the inner peripheral face of the second exhaust pipe by using the fixing means, disengagement of the seal ring is less likely to occur and, consequently, the first insertion end portion of the first exhaust pipe is easily inserted into the second insertion end portion of the second exhaust pipe. As the fixing means, a tape such as cellophane tape, masking tape, a bonding agent, or the like, which are combustible or heat soluble, may be used. The fixing means is heated by the high-temperature exhaust gas discharged from the engine during starting of the engine and, as a result, it vanishes. The connecting portions are reliably sealed. As a matter of course, this heating may be conducted using a burner after connection of the first and second exhaust pipes is completed. When the tape or the like is used as the fixing member, insertion is facilitated by forming a taper face between the outer peripheral face of the first exhaust pipe and the seal ring or between the inner peripheral face of the second exhaust pipe and the seal ring protruding from the inner peripheral face.

According to the present invention, there is further provided an exhaust passage configured to discharge an exhaust gas from an engine for driving a propulsion device of a small watercraft, comprising an exhaust pipe partially forming the exhaust passage, and a water muffler connected to the exhaust pipe, wherein a downstream end portion of the exhaust pipe is accommodated in the water muffler such that its downstream end is higher than an upstream portion of the exhaust pipe within the water muffler.

In accordance with the exhaust passage configured as described above, since the downstream end of the exhaust pipe is located at a position spaced apart from the bottom portion of the water muffler, the water reserved in the bottom portion is inhibited from flowing back toward the engine during start of the engine. In addition, when the watercraft is almost inverted, backflow of the water within the water muffler due to gravity does not occur, because the downstream end of the exhaust pipe is located higher than the upstream portion of the exhaust pipe within the water muffler.

The downstream end of the exhaust pipe may be located in the vicinity of a center line in a vertical direction of the water muffler.

The exhaust pipe may be provided with a water jacket on an outer peripheral portion of the exhaust pipe, and a water supply port may be provided at the downstream end of the exhaust pipe to supply water from the water jacket to an exhaust gas discharged from the downstream end of the exhaust pipe.

The water supply port may be provided at an upper end portion of the downstream end of the exhaust pipe. The water supply port serves to release the air within the water jacket and supply water into the water muffler. The water supplied through the water supply port makes contact with the exhaust gas outflowing from the exit of the exhaust pipe, thereby reducing the temperature of the exhaust gas efficiently. By the flow of the exhaust gas, the water mist is supplied uniformly into the water muffler and uniformly reduces the temperature of the exhaust gas flowing into the water muffler.

An end face at the downstream end of the exhaust pipe may be configured to be vertical or inclined such that its lower end is closer to upstream side than is its upper end, and the water supply port may be configured to protrude toward the downstream side more greatly than does the lower end of the exhaust pipe. In this structure, the water outflowing from the water supply port does not flow into the exhaust pipe.

The water jacket of the exhaust pipe may be internally provided with a separating wall that defines an upper water jacket and a lower water jacket. In this structure, the cooling water serves to uniformly cool the upper portion and the lower portion of the exhaust pipe.

A communicating port is provided on the separating wall at the downstream end of the exhaust pipe to allow the lower water jacket and the upper water jacket to communicate with each other. In this structure, the cooling water that has cooled the lower water jacket and increased its temperature smoothly flows up to the upper water jacket so that the cooling water flows within the water jacket smoothly.

The lower water jacket may be provided with a cooling water supply port to supply cooling water into the water jacket, and the upper water jacket is provided with a discharge port to discharge the cooling water from the water jacket.

According to the present invention, there is further provided a water muffler in which a downstream end portion of an exhaust pipe partially forming an exhaust passage configured to discharge an exhaust gas from an engine for driving a propulsion device of a small watercraft is accommodated, the water muffler comprising an exhaust chamber configured to discharge an exhaust gas inflowing from the engine outside the water muffler; a concave portion formed on a bottom portion of the exhaust chamber; and a discharge pipe extending upwardly from the concave portion of the exhaust chamber such that its upper end extends to an outside of the water muffler and its lower end is located higher than a bottom face of the concave portion.

In accordance with the water muffler so structured, since the lower end of the discharge pipe is located lower than the center line in the vertical direction of the water muffler, the water outside the watercraft is inhibited from flowing into the water muffler through the second exhaust pipe when the watercraft is inverted. In addition, since the water within the water muffler is reserved in the concave portion provided on the bottom portion of the exhaust chamber, the water within the water muffler is smoothly discharged outside the watercraft.

The water muffler may be configured to have a first chamber, a second chamber, and a third chamber which are arranged in-line in this order from an upstream end side of the exhaust pipe. A downstream end of the exhaust pipe to be inserted may be located within the second chamber, and the exhaust chamber may be the third chamber.

The above and further objects and features of the invention will be more fully be apparent from the following detailed description with accompanying drawings.

DETAILED DESCRIPTION OF THE PREFERRED EMBODIMENTS

Hereinafter, preferred embodiments of small watercraft of the present invention will be described with reference to the accompanying drawings. Here, a jet-propulsion personal watercraft will be described. It should be noted that the present invention may be applied to small watercraft other than the personal watercraft.

Figure 8:
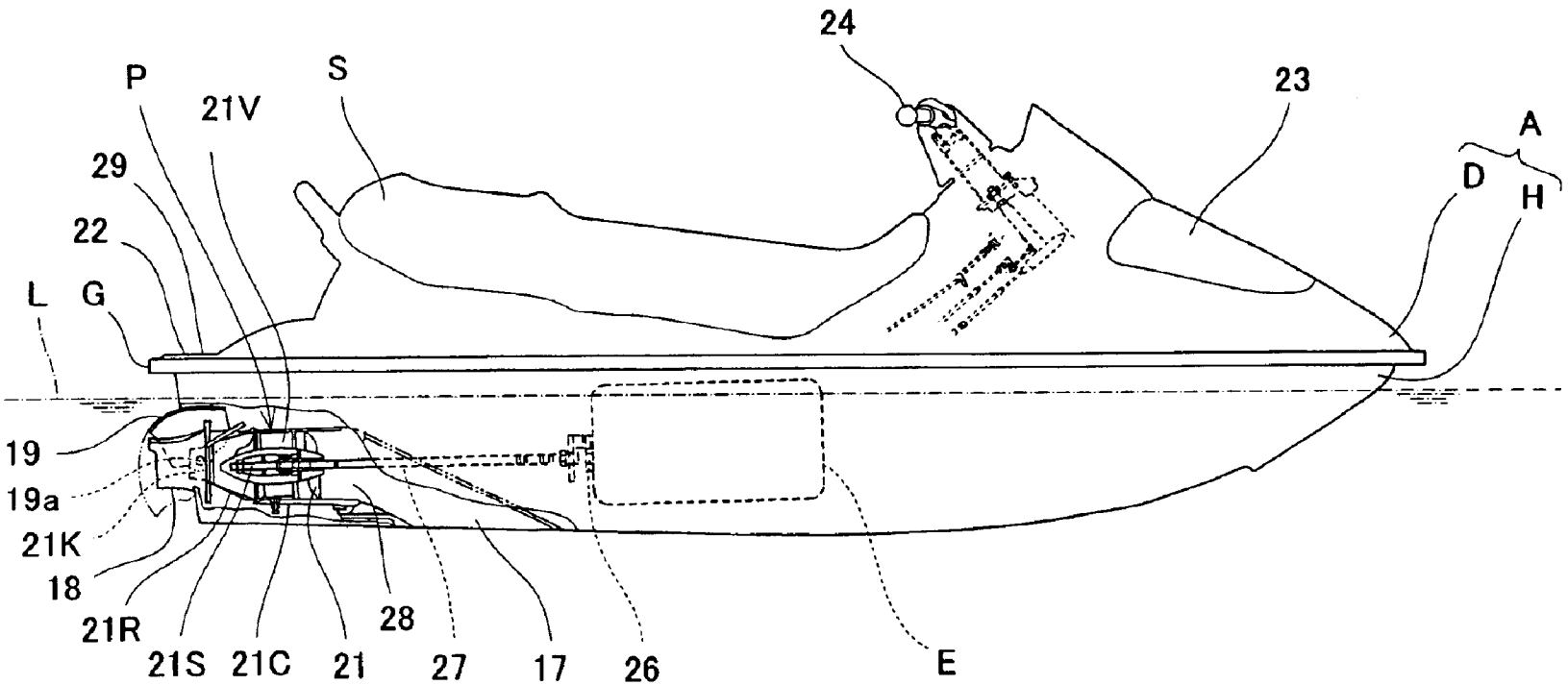
FIG. 8 is a side view of a jet-propulsion personal watercraft of the present invention.
Figure 9:
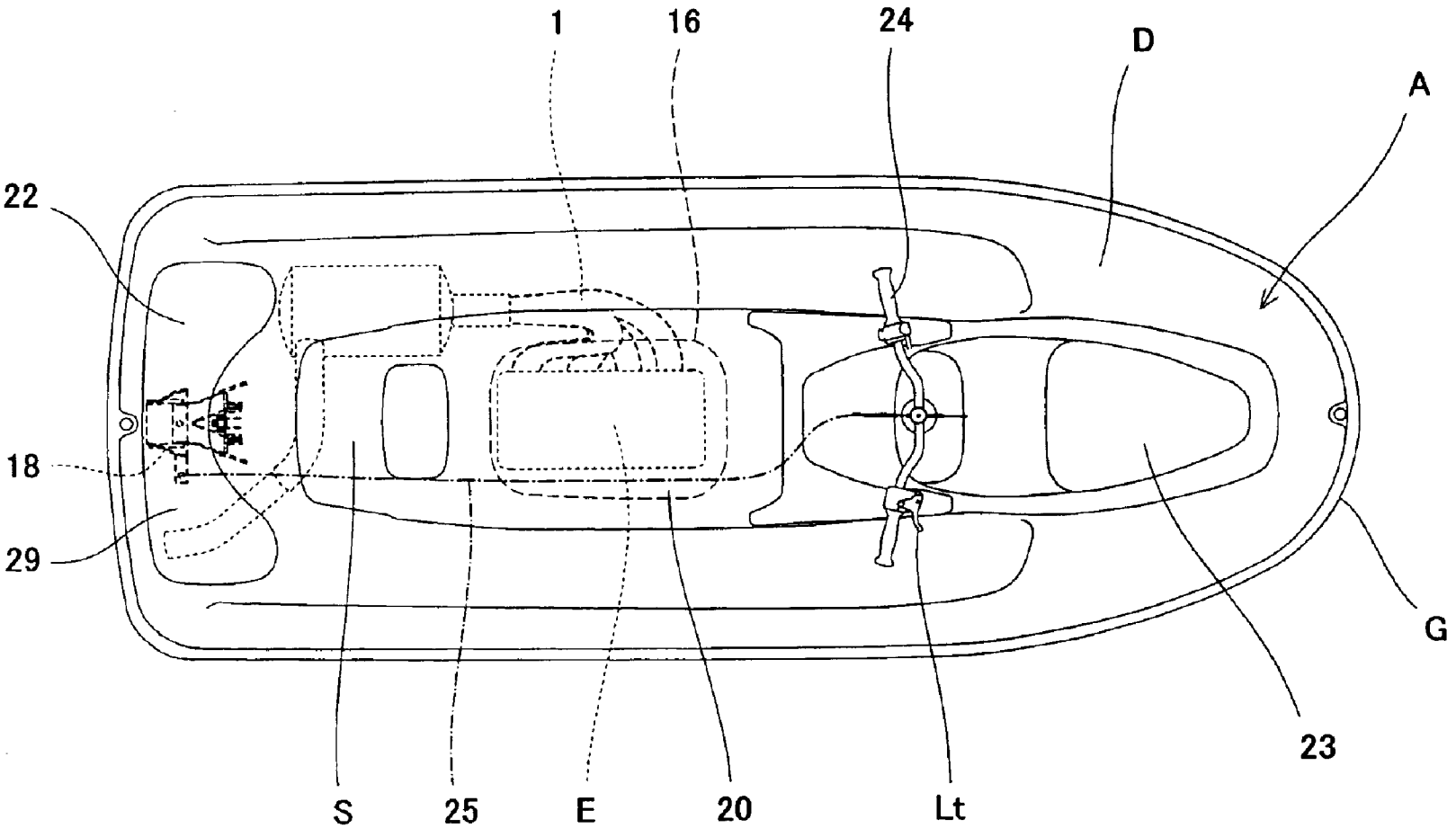
FIG. 9 is a plan view showing the personal watercraft in FIG. 8.

In FIGS. 8 and 9, reference numeral A denotes a body of the personal watercraft. The body A comprises a hull A and a deck D covering the hull H from above. A line at which the hull H and the deck D are connected over the entire perimeter thereof is called a gunnel line G. In these figures, L denotes a waterline.

As shown in FIG. 9, an opening 16, which has a substantially rectangular shape seen from above, is formed at a relatively rear section of the deck D such that it extends in the longitudinal direction of the body A, and a riding seat S is mounted above the opening 16 such that it covers the opening 16 from above as shown in FIGS. 8 and 9.

An engine E is contained in an engine room 20 surrounded by the hull H and the deck D below the seat S and having a convex-shape in a cross section of the body A. In this embodiment, the engine E is a multi-cylinder (four-cylinder) four-cycle engine. As shown in FIG. 8, the engine E is mounted such that a crankshaft 26 extends along the longitudinal direction of the body A. An output end of the crankshaft 26 is rotatably coupled integrally with a pump shaft 21S of a water jet pump P through a propeller shaft 27. An impeller 21 is mounted on the output shaft 21S of the water jet pump P. The impeller 21 is covered with a pump casing 21C on the outer periphery thereof. A water intake 17 is provided on the bottom of the hull H. The water is sucked from the water intake 17 and fed to the water jet pump P through a water intake passage 28. The water jet pump P pressurizes and accelerates the water. The pressurized and accelerated water is discharged through a pump nozzle 21R having a cross-sectional area of flow that gradually reduces in a rearward direction, and from an outlet portion 21K provided on the downstream end of the pump nozzle 21R, thereby obtaining the propulsion force.

In FIG. 8, reference numeral 21V denotes fairing vanes for fairing water flow inside the water jet pump P. As shown in FIGS. 8 and 9, reference numeral 24 denotes a bar-type steering handle. By operating the steering handle 24 to the right or to the left, the steering nozzle 18 provided behind the pump nozzle 21R swings to the right or to the left through a wire cable 25 as represented by a dashed line in FIG. 9. The watercraft can be turned to any desired direction while the water jet pump P is generating the propulsion force. A throttle lever Lt in FIG. 9 serves to adjust an engine speed of the engine E.

As shown in FIG. 8, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward and, as the resulting reaction, the personal watercraft moves rearward.

In FIGS. 8 and 9, reference numeral 22 denotes a rear deck. The rear deck 22 is provided with an operable hatch cover 29. A rear compartment (not shown) with a small capacity is provided under the hatch cover 29. Reference numeral 23 denotes a front hatch cover. A front compartment (not shown) is provided under the front hatch cover 23 for storing equipment and the like.

Embodiment 1

Figure 7:
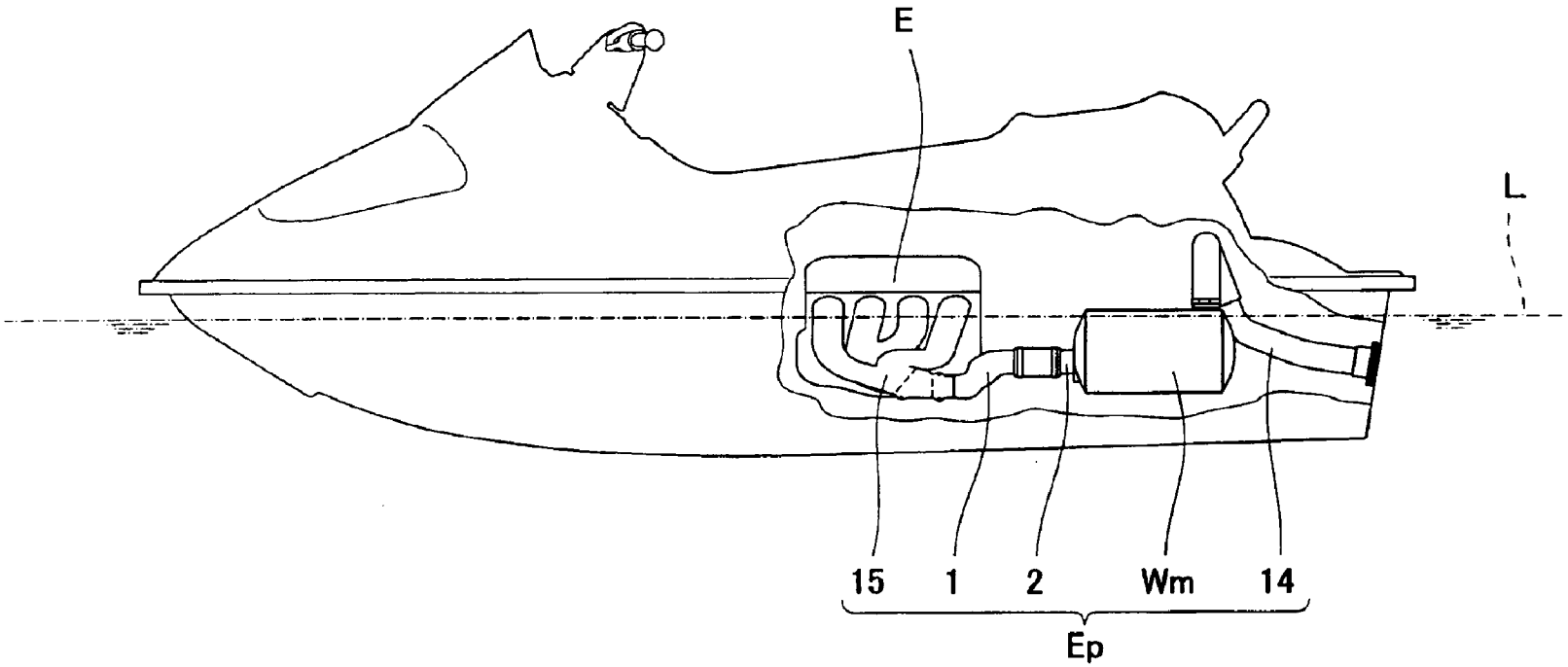
FIG. 7 is a side view of the personal watercraft, showing the entire exhaust passage having the exhaust passage in FIG. 1 and FIGS. 4 to 6, with a hull and a deck cut away.

As shown in FIG. 7, exhaust ports of the engine E of the personal watercraft are connected to an exhaust passage Ep for discharging an exhaust gas from the engine E outside the watercraft. The exhaust passage Ep comprises an exhaust manifold 15 having an upstream end connected to exits of the exhaust ports, an upstream exhaust pipe 1 connected to a downstream end of the exhaust manifold 15, and a downstream exhaust pipe 2 connected to a downstream end of the upstream exhaust pipe 1, a water muffler Wm provided on the rear portion of the body A, and a discharge exhaust pipe 14 for leading the exhaust gas from the water muffler Wm outside the watercraft. As used herein, "upstream" and "downstream" are associated with a flow of an exhaust gas.

The water muffler Wm accommodates a downstream end portion 2A (see FIGS. 1 and 2, right end portion in FIG. 6) of the downstream exhaust pipe 2. In the exhaust passage Ep, a downstream end portion 1A of the upstream exhaust pipe 1 and an upstream portion 2B of the downstream exhaust pipe 2 are connected by a connecting structure shown in FIG. 1 or FIG. 2 (partially enlarged view in FIG. 1). Specifically, the downstream end portion 1A as a connecting end portion of the upstream exhaust pipe 1 is provided with a tubular insertion end portion 1*a* that protrudes toward the upstream end portion 2B of the downstream exhaust pipe 2. The upstream end portion 2B of the downstream exhaust pipe 2 as a connecting end portion of the downstream exhaust pipe 2 is provided with a tubular insertion end portion 2*a* having an inner peripheral face configured to accommodate the tubular insertion end portion 1*a* of the upstream exhaust pipe 1.

Figure 2:
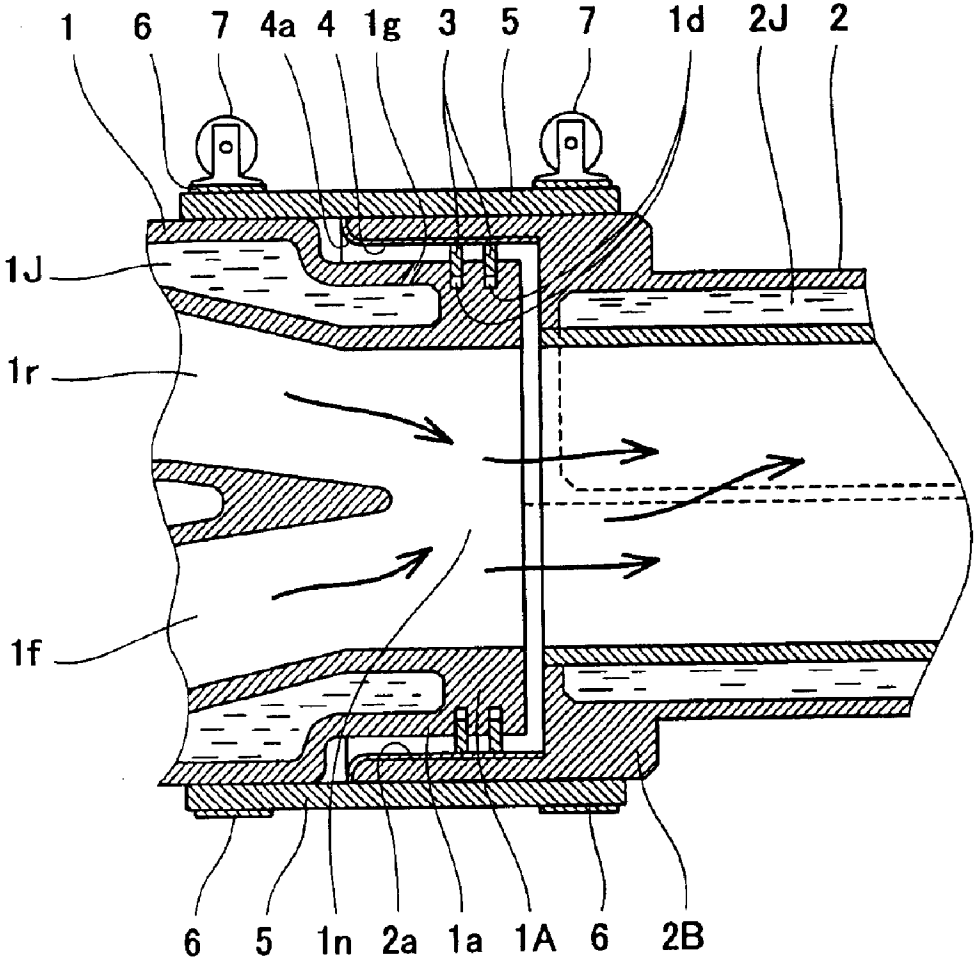
FIG. 2 is a partially enlarged cross-sectional view showing a structure of the connecting portion in FIG. 1.

As shown in FIG. 2, a ring groove 1*d* is provided on an outer peripheral face of the insertion end portion 1*a* of the upstream exhaust pipe 1 so as to extend circumferentially over the entire insertion end portion 1*a*. A seal ring 3 is provided in the ring groove 1*d*. The seal ring 3 is comprised of a spring steel. Part of the seal ring 3 is cut, as in a well-known piston ring of the engine. Under the condition in which no external force is applied to the seal ring 3, an outer peripheral face of the seal ring 3 has an outer diameter larger than the inner diameter of the inner peripheral face of the insertion end portion 2*a*, while upon application of the external force, the outer peripheral face of the seal ring 3 can be elastically deformed so as to have a diameter smaller than that of the inner peripheral face of the insertion end portion 2*a*. As in the piston ring of the engine, the seal ring 3 is configured to engage in the ring groove 1*d*, and with the outer periphery of the seal ring 3 biased toward the inner peripheral face of the insertion end portion 2*a* (or inner peripheral surface of a sleeve 4 when the sleeve 4 is fitted to the inner peripheral face of the insertion end portion 2*a*) so as to increase the diameter by a spring force, the outer periphery of the seal ring 3 is in contact with the inner peripheral face of the insertion end portion 2*a*. Under this condition, a gap is created between the inner peripheral face of the seal ring 3 and a bottom portion of the ring groove 1 to allow the seal ring 3 to be compressed to reduce the diameter.

In this embodiment, a tubular sleeve 4 is fitted to the inner peripheral face of the insertion end portion 2*a* for improvement of wear resistance to contact with the seal ring 3. The tubular sleeve 4 is made of stainless steel and is highly durable. The sleeve 4 has an end portion 4*a* flared toward a connecting end of the insertion end portion 2*a* to have an inner diameter that increases in the radial direction. The sleeve 4 is fitted to the insertion end portion 2*a* such that the flared end portion 4*a* is located at the connecting end of the insertion end portion 2*a* of the downstream exhaust pipe 2. The material of the sleeve 4 is not intended to be limited to stainless steel, but other materials including titanium metal, chromium metal, ceramics, etc, may be used.

As shown in FIG. 2, a water passage 1*g* having a small diameter extends from a water jacket 1J formed on an outer peripheral region of the upstream exhaust pipe 1 to an outer peripheral face of the insertion end portion 1*a* to allow the cooling water to flow from the water jacket 1J into a space between the upstream exhaust pipe 1 provided with the seal ring 3 and the ring groove 1*d*, and the downstream exhaust pipe 2. As a result, the seal ring 3 slides smoothly on the ring groove 3.

The upstream exhaust pipe 1 internally has a merging portion where exhaust passages are merged. Specifically, the exhaust manifold 15 (FIG. 7) is configured to collect four exhaust paths on the upstream side into two exhaust paths, and the upstream exhaust pipe 1 is configured to collect the two exhaust paths 1*r* and 1*f* connected to two exhaust paths of the exhaust manifold 15 into a single exhaust path 1*n*.

Figure 1:
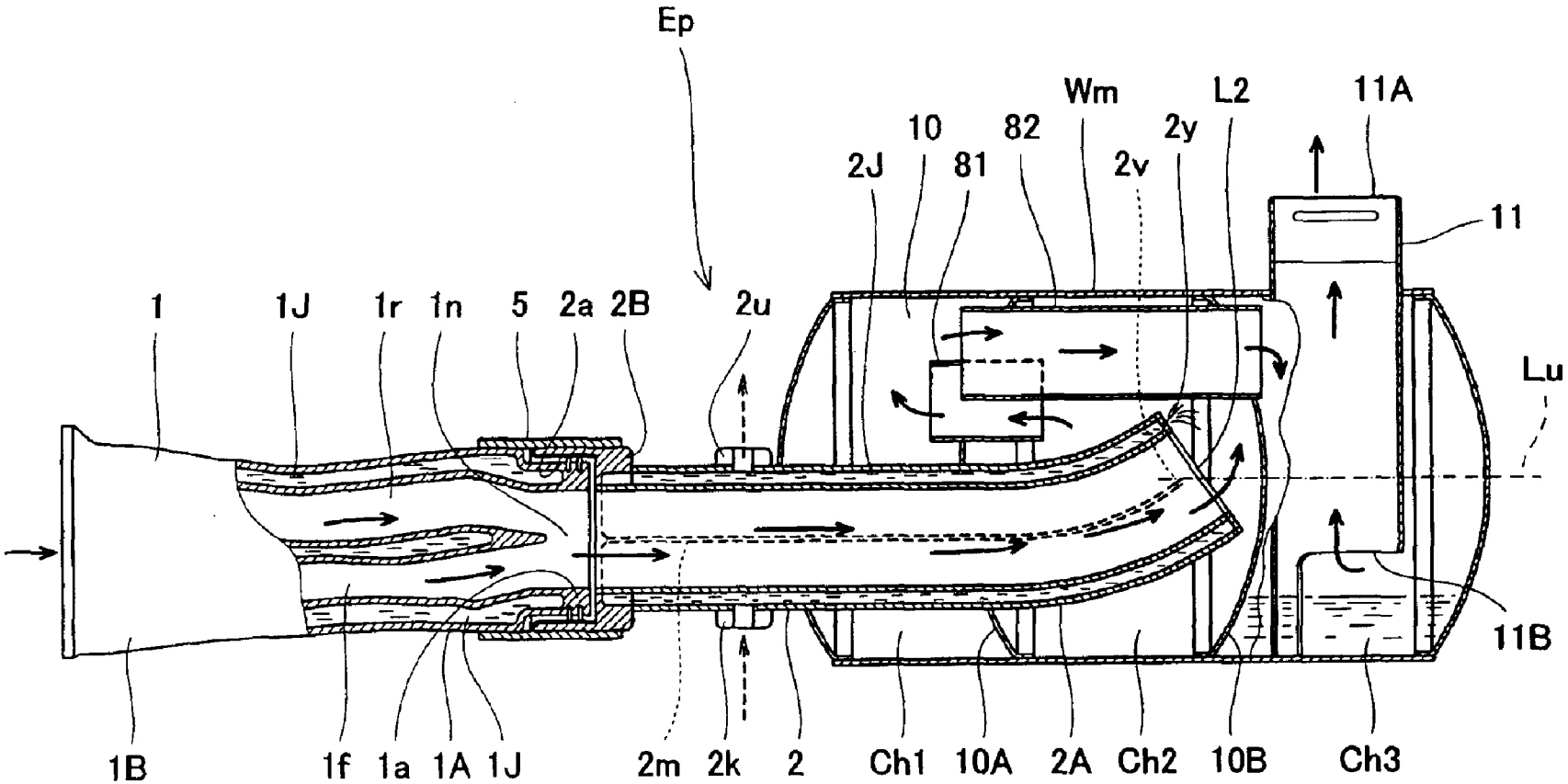
FIG. 1 is a cross-sectional view showing a structure of an exhaust passage including a connecting portion of an upstream exhaust pipe and a downstream exhaust pipe, which is provided in a four-cycle engine mounted in a personal watercraft according to a first embodiment of the present invention.

In this embodiment, as shown in FIG. 1 or 2, a portion adjacent to the connecting end portion of the upstream exhaust pipe 1 and the connecting portion of the downstream exhaust pipe 2 have a substantially equal outer diameter. The connecting portion of the upstream exhaust pipe 1 and the connecting portion of the downstream exhaust pipe 2 are covered by a cover sleeve 5. The cover sleeve 5 is made of rubber, more specifically, NBR or PVC, or the like. Alternatively, the cover sleeve 5 may be made of a composite material with a steel inner peripheral face covered with rubber, or rubber containing a reinforcement agent.

As shown in FIG. 2, with the cover sleeve 5 attached to the outer periphery of the connecting portions, both sides thereof are preferably fastened thereto by steel bands 6 with fitting members 7. Thereby, the sealing effect is enhanced. In FIG. 1, the steel bands 6 with the fitting members 7 are omitted. As shown in FIG. 1 or 2, the downstream exhaust pipe 2 has a double-walled structure and a water jacket 2J is formed on an outer peripheral region of the downstream exhaust pipe 2 as in the case of the upstream exhaust pipe 1. As shown in FIG. 1, the downstream end portion 2A of the downstream exhaust pipe 2 is accommodated within the water muffler Wm and is gradually bent upwardly. In this embodiment, a center L2 of the downstream end of the downstream exhaust pipe 2 conforms to a center line Lu in the vertical direction of the water muffler Wm.

As shown in FIG. 1, a water supply port 2*y* is provided at an upper end portion of the downstream end of the downstream exhaust pipe 2 so as to communicate with the water jacket 2J. From the water supply port 2*y*, the cooling water within the water jacket 2J is supplied into the exhaust gas within the water muffler Wm. As shown in FIG. 1, the water muffler Wm is horizontally provided and substantially drum-shaped. The water muffler Wm has an expansion chamber 10 inside thereof. Inside the expansion chamber 10, separating walls 10A and 10B vertically extend to define a first chamber Ch1, a second chamber Ch2, and a third chamber Ch3 that are arranged in-line in this order from the front side (left side in FIG. 1) of the watercraft. The downstream end of the downstream exhaust pipe 2 opens inside the second chamber Ch2 located at the center in the longitudinal direction of the water muffler Wm. The second chamber Ch2 communicates with the first chamber Ch1 through a first communicating pipe 81 and the first chamber Ch1 communicates with the third chamber Ch3 through a second communicating pipe 82. As represented by a bold arrow, the exhaust gas flows from the downstream end of the downstream exhaust pipe 2 into the second chamber Ch2 and flows from the second chamber Ch2 into the first chamber Ch1 through the first communicating pipe 81. Then, the exhaust gas flows from the first chamber Ch1 into the third chamber Ch3 through the second communicating pipe 82.

And, a discharge pipe 11 is provided substantially vertically inside the third chamber Ch3 such that an upstream end 11B opens inside the third chamber Ch3. A downstream end 11A of the discharge pipe 11 is connected to an upstream end of the discharge exhaust pipe 14 (FIG. 7). As shown in FIG. 7, an upper end of the water muffler Wm is substantially as high as the water line L. To be precise, the waterline L is slightly lower than the upper end of the water muffler Wm and higher than an upper end of the downstream exhaust pipe 2.

Figure 10:
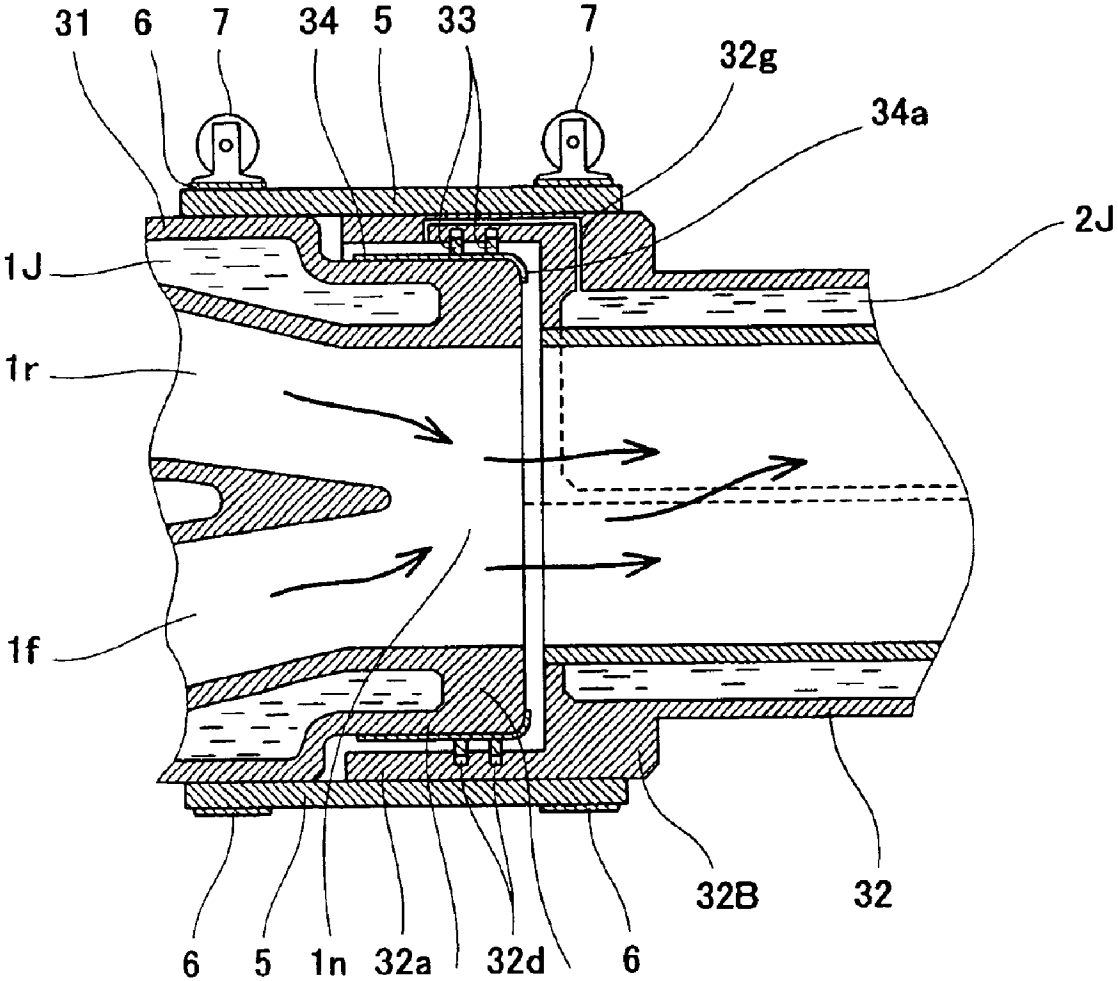
FIG. 10 is a partially enlarged view showing another structure of the connecting structure of the upstream exhaust pipe and the downstream exhaust pipe.

FIG. 10 is a partially enlarged view showing another connecting structure of the upstream exhaust pipe and the downstream exhaust pipe, which is different from that shown in FIG. 2. In FIG. 10, the same reference numerals as those in FIG. 2 denote the same or corresponding parts.

A downstream end portion 31A as a connecting end portion of an upstream exhaust pipe 31 is provided with a tubular insertion end portion 31*a* having an outer peripheral face that is concentric with the upstream exhaust pipe 31. An upstream end portion 32B as a connecting end portion of a downstream exhaust pipe 32 is provided with a tubular insertion end portion 32*a* having an inner peripheral face that is concentric with the downstream exhaust pipe 32, and configured to accommodate the tubular insertion end portion 31*a*. An inner diameter of the insertion end portion 32*a* is slightly larger than an outer diameter of the insertion end portion 31*a*. The insertion end portion 32*a* is configured to be concentric with the insertion end portion 31*a* after insertion. When the insertion end portion 31*a* is inserted into the insertion end portion 32*a*, there is a slight gap between the inner peripheral face of the insertion end portion 32*a* and the outer peripheral face of the insertion end portion 31*a*.

A tubular sleeve 34 is fitted to an outer peripheral face of the insertion end portion 31*a*. An end portion 34*a* of the sleeve 34 has an outer diameter that gradually reduces in the radial direction toward a connecting end of the insertion end portion 31*a*. The sleeve 34 is fitted to the insertion end portion 31*a* such that the end portion 34*a* is located at the connecting end of the insertion end portion 31*a* of the upstream exhaust pipe 31.

A ring groove 32*d* is provided on an inner peripheral face of the insertion end portion 32*a* to extend circumferentially over the entire insertion end portion 32*a*. A seal ring 33 is provided in the ring groove 32*d*. The seal ring 33 has an inner peripheral face that is radially expandable and compressive (elastically deformable). Under the condition in which no external force is applied to the seal ring 33, an inner peripheral face of the seal ring 33 has an inner diameter smaller than the outer diameter of the outer peripheral face of the insertion end portion 31*a*, while upon application of the external force, the seal ring 33 can be elastically deformed so as to have an inner diameter larger than the outer diameter of the insertion end portion 31*a*.

With the insertion end portion 31*a* accommodated in the insertion end portion 32*a*, the seal ring 33 engaging in the ring groove 32*d* is biased to the inner side to allow its inner peripheral face to be in contact with (pressed into) the outer peripheral face of the insertion end portion 31*a* (outer peripheral face of the sleeve 34 in this embodiment). Under the condition, a gap is created between the bottom portion of the ring groove 32*d* and the outer peripheral face of the seal ring 33 to allow the seal ring 33 to increase its diameter.

A water passage 32*g* having a small diameter extends from a water jacket 2J formed on the downstream exhaust pipe 32 to the gap between the insertion end portion 31 and the insertion end portion 32. The cooling water within the water jacket 2J flows through the water passage 32*g* and is supplied to the seal ring 33 and the ring groove 32*d*. As a result, the seal ring 33 slides smoothly on the groove 32*d*.

In accordance with the exhaust passage configured as described, the following function and effects are obtained. The engine E and the water muffler Wm belong to different vibration systems, as described above. However, the vibration of the engine E is inhibited from being transmitted to the water muffler Wm because of the connecting structure of the exhaust passage. In other words, the water muffler Wm can vibrate individually. In addition, instead of the "wet type," "dry type" in which water is not supplied into the exhaust passage (exhaust passage of the upstream exhaust pipe 1) can be adopted. As shown in FIG. 2, when the downstream exhaust pipe 2 fixed to the water muffler Wm and the upstream exhaust pipe 1 fixed to the engine E side individually vibrate, the outer peripheral face of the seal ring 3 is in contact with the inner peripheral face of the sleeve 4 by a spring force of the seal ring 3. This structure avoids transmission of the vibration of one of the exhaust pipes 1 and 2 to the other. In addition, the exhaust pipes 1 and 2 can be sealed. Further, since the seal ring 3 is formed of a heat-resistant material, for example, metal, the "dry type" may be adopted in the exhaust passage. In this structure, since water need not be supplied into the exhaust passage on the upstream side of the connecting portion, the exhaust passage that does not increase the back pressure and does not degrade engine performance is gained.

Instead of the spring steel, the seal ring 3 may be made of shape-memory metal. Martensite shape-memory metal is restored to its original shape by heating after it has been greatly deformed by an external force. Therefore, the seal ring made of the shape-memory metal and having an original shape with proper seal ability is preferably used. When the upstream exhaust pipe 1 and the downstream exhaust pipe 2 are connected to each other, the seal ring is predeformed for facilitating connection and, after connection, the connecting portions are heated. As a result, the seal ring is restored to its original shape with the exhaust pipes connected to each other and, after connection, the seal ring produces a seal effect. The connecting portions may be heated by using an external heat source, for example, a heater, or by a high-temperature exhaust gas discharged from the engine E.

Subsequently, an exhaust passage that inhibits back flow of the water reserved inside thereof will be described. As described above, since the downstream end portion 2A of the downstream exhaust pipe 2 is configured to be higher than the upstream end, and the center L2 of the downstream end of the downstream exhaust pipe 2 substantially conforms to the center line Lu in the vertical direction of the water muffler Wm, the downstream end of the downstream exhaust pipe 2 is kept higher than the liquid level of the water reserved in the bottom portion of the second chamber Ch2 of the water muffler Wm. Therefore, during re-starting of the engine, back flow of the water from the water muffler Wm to the engine E is inhibited. In addition, as described above, the exhaust passage from the upstream exhaust pipe to the downstream exhaust pipe employs the "dry type," the water reserved inside the second chamber Ch2 of the water muffler Wm is little and therefore the water that would flow back toward the engine E is correspondingly little.

Further, in the exhaust passage of this embodiment, as shown in FIG. 1, a separating wall 2*m* that defines upper and lower water jackets 2J of the downstream exhaust pipe 2 is provided at a location other than the communicating port 2*v* at the downstream end, and the cooling water is supplied from a cooling water supply port 2*k* provided on the lower side of the upstream end portion 2B of the downstream exhaust pipe 2, flows through the communicating port 2*v*, and is discharged from a cooling water discharge port 2*u* provided on the upper side of the upstream end portion 2B outside the watercraft. In this structure, the downstream exhaust pipe 2 is cooled by the cooling water evenly and efficiently.

Subsequently, the flow of the exhaust gas and the muffling effect of the exhaust passage Ep will be described. As shown in FIG. 1, the exhaust gas flows from the exhaust manifold 15 in FIG. 7 into the upstream exhaust pipe 1. Then, the exhaust gas flows into the downstream exhaust pipe 2 through the connecting portions of the upstream exhaust pipe 1 and the downstream exhaust pipe 2 and then flows from the downstream end of the downstream exhaust pipe 2 into the second chamber Ch2 of the water muffler Wm. During this time, the exhaust gas is cooled by the cooling water within the water jackets 1J and 2J and energy from the exhaust gas is reduced, so that the exhaust gas is muffled. While the exhaust gas is flowing from the downstream end of the downstream exhaust pipe 2 into the second chamber Ch2 of the water muffler Wm, the exhaust gas expands and is thereby muffled. In particular, since the cooling water is supplied from the water supply port 2*y* at the downstream end of the downstream exhaust pipe 2, the exhaust gas is effectively cooled and muffled by the cooling water. In addition, since the cooling water becomes mist by the flow of the exhaust gas, the exhaust noise is absorbed by the water mist. Then, the exhaust gas flows from the second chamber Ch2 of the water muffler Wm into the first chamber Ch1 through the communicating pipe 81 and re-expands and is re-muffled therein. Then, the exhaust gas flows from the first chamber Ch1 into the third exhaust chamber Ch3 through the communicating pipe 82 and re-expands and is re-muffled therein. Finally, the exhaust gas is discharged from the third chamber Ch3 outside the water muffler Wm through the discharge pipe 11. At this time, the water reserved in the bottom portion of the third chamber Ch3 is discharged outside the water muffler Wm by the flow of the exhaust gas. Thereby, the energy of the exhaust gas is consumed by this action and the exhaust gas is further muffled. In addition, by contact with the water, an exhaust gas, in particular, an exhaust gas in a higher frequency range is absorbed by the water mist and is effectively muffled.

In the exhaust passage Ep, the upper end of the water muffler Wm is located substantially as high as the water line L as shown in FIG. 7, and the downstream end of the downstream exhaust pipe 2 is higher than upstream side within the water muffler Wm, and the center L2 of the downstream exhaust pipe 2 substantially conforms to the center Lu in the vertical direction of the water muffler Wm as shown in FIG. 1. In this structure, even when the watercraft is almost inverted, the water outside the watercraft is inhibited from flowing from the downstream end of the exhaust passage Ep into the water muffler Wm. In addition, the water flowing into the water muffler Wm is inhibited from flowing from the downstream exhaust pipe 2 into the upstream exhaust pipe 1.

Figure 3:
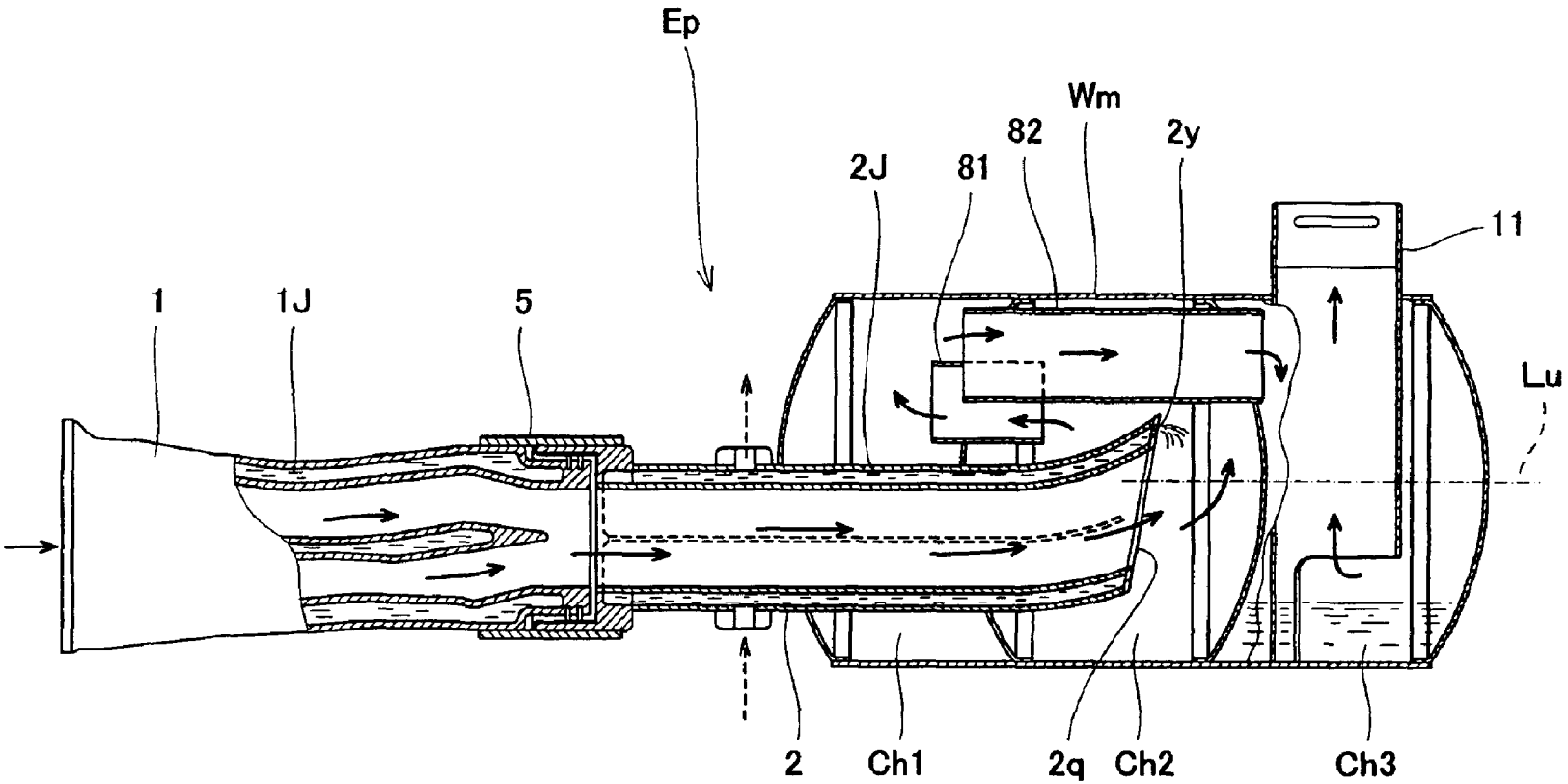
FIG. 3 is a cross-sectional view showing another structure of the exhaust passage, which differs in a downstream end structure of the exhaust passage from the exhaust passage in FIG. 1.

Preferably, an end face 2*q* of the downstream end of the downstream exhaust pipe 2 is cut to be substantially vertical or to have an acute angle (an angle made by the end face 2*q* having a lower end deviating toward upstream side of the downstream exhaust pipe 2 with respect to vertical line), and the water supply port 2*y* protrudes toward the downstream side more greatly than does a lower portion of the downstream end of the downstream exhaust pipe 2. In this structure, the cooling water ejected from the water supply port 2*y* is inhibited from dropping into the downstream exhaust pipe 2. In FIG. 3, the same reference numerals as those in FIG. 1 denote the same or corresponding parts.

In some cases, when the upstream exhaust pipe 1 and the downstream exhaust pipe 2 are connected to each other, the seal ring 3 provided between the exhaust pipes 1 and 2 disengages from the ring groove 1*d* and work for fitting (connecting) the exhaust pipes 1 and 2 to each other, becomes difficult. In such cases, preferably, the upstream and downstream exhaust pipes 1 and 2 are connected by a connecting method as described below.

Figure 11A:
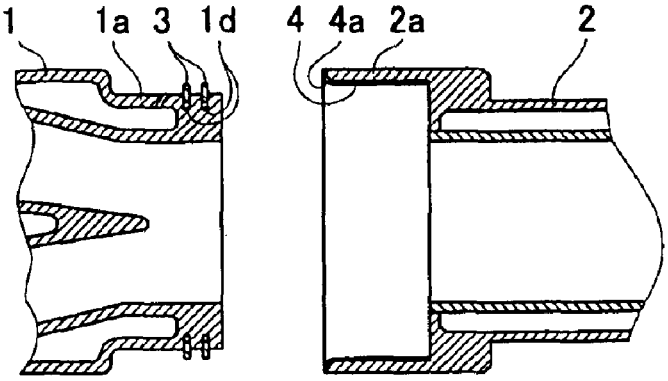
FIG. 11A is a schematic view showing a first configuration in which the upstream exhaust pipe and the downstream exhaust pipe in FIG. 2 are connected to each other.

FIGS. 1A and 1B are schematic views showing a procedure of connecting the upstream and downstream exhaust pipes 1 and 2. As shown in FIG. 11A, prior to connection between the upstream and downstream exhaust pipes 1 and 2, the seal ring 3 engages in the ring groove 1*d* formed on the outer peripheral face of the insertion end portion 1*a* of the upstream exhaust pipe 1 and the sleeve 4 is fitted to the insertion end portion 2*a* of the downstream exhaust pipe 2.

Figure 11B:
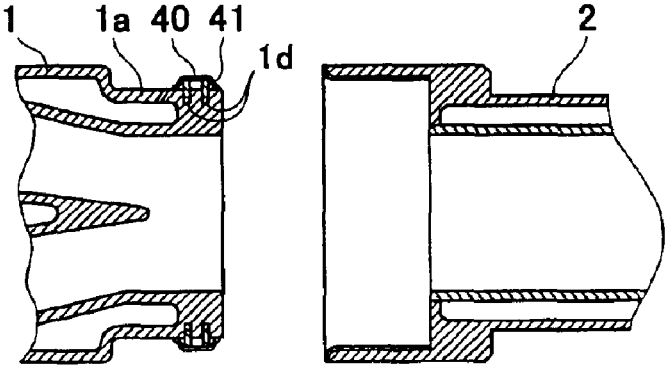
FIG. 11B is a schematic view showing a second configuration in which the upstream exhaust pipe and the downstream exhaust pipe in FIG. 2 are connected to each other.

Subsequently, as shown in FIG. 11B, a tape 40 is attached to the outer periphery of the seal ring 3 engaging in the ring groove 1*d* to allow the seal ring 3 to be fitted to the outer peripheral face of the insertion end portion 1*a*. That is, the tape 40 exerts a force to cause the seal ring 3 to reduce the diameter. When the tape 40 is attached to the seal ring 3, a taper face 41 is preferably formed between the outer peripheral face of the insertion end portion 1*a* on the downstream end side and the outer peripheral portion of the seal ring 3, for the purpose of smooth insertion. The tape 40 is combustible or heat-soluble. Further, instead of the tape 40, combustible or heat-soluble bonding agent may be used to fix the seal ring 3 to the outer peripheral face of the insertion end portion 1*a* with the diameter of the sear ring 3 reduced.

Figure 11C:
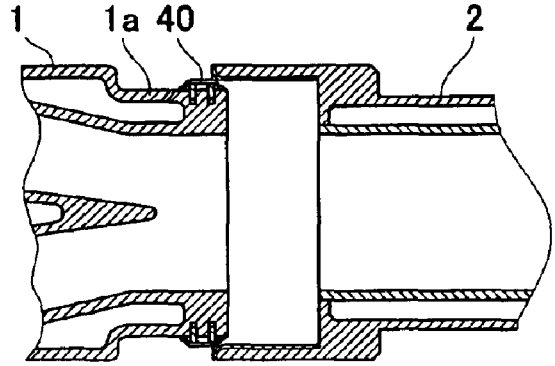
FIG. 11C is a schematic view showing a third configuration in which the upstream exhaust pipe and the downstream exhaust pipe in FIG. 2 are connected to each other.
Figure 11D:
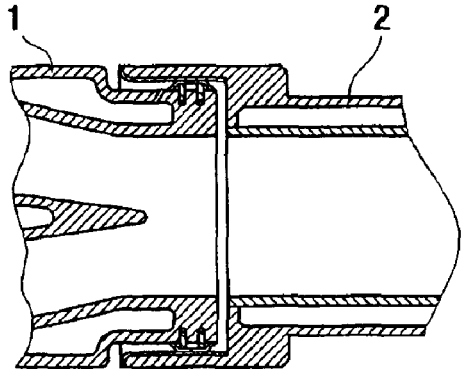
FIG. 11D is a schematic view showing a fourth configuration in which the upstream exhaust pipe and the downstream exhaust pipe in FIG. 2 are connected to each other.

With the seal ring 3 fixed to the outer peripheral face of the insertion end portion 1*a*, the upstream exhaust pipe 1 is inserted into the downstream exhaust pipe 2 (FIG. 11C). When the upstream exhaust pipe 1 is inserted into the downstream exhaust pipe 2 by a predetermined distance, connection between the upstream and downstream exhaust pipes 1 and 2 is completed.

When the exhaust pipes 1 and 2 are connected to each other by the above method, the tape 40 serves to fix the seal ring 30 to the outer peripheral face of the insertion end portion 1*a* of the upstream exhaust pipe 1. In addition, since the taper face 41 is formed by the tape 40, the insertion end portion 1*a* of the upstream exhaust pipe 1 can be easily inserted into the insertion end portion 2*a* of the downstream exhaust pipe 2. Furthermore, when the tape 40 is attached to the seal ring 3 with the diameter of the seal ring 3 greatly reduced, insertion is facilitated. The end portion 4*a* of the sleeve 4 is flared to have an inner diameter increased for facilitating the above insertion.

Figure 12A:
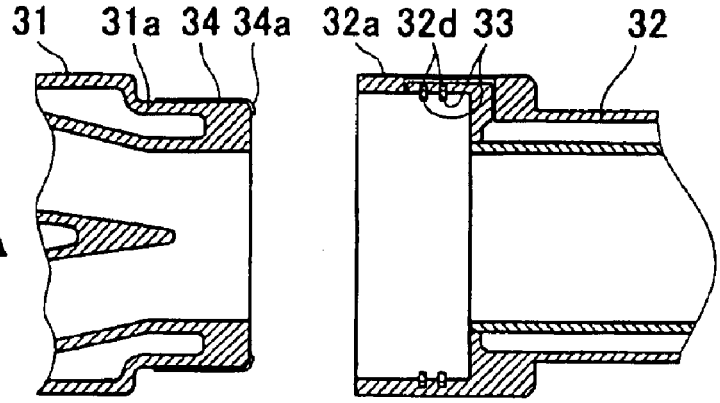
FIG. 12A is a schematic view showing a first configuration in which the upstream exhaust pipe and the downstream exhaust pipe in FIG. 10 are connected to each other.
Figure 12B:
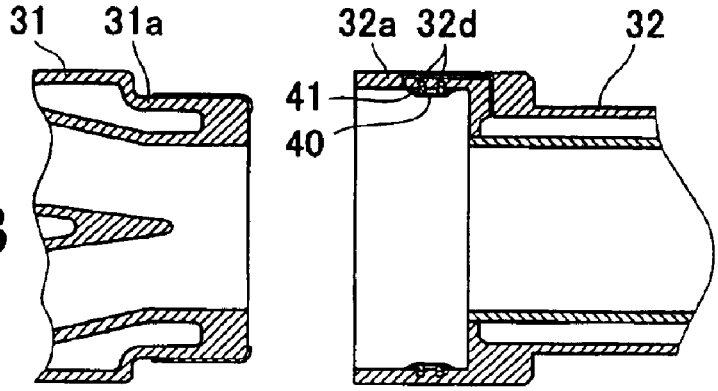
FIG. 12B is a schematic view showing a second configuration in which the upstream exhaust pipe and the downstream exhaust pipe in FIG. 10 are connected to each other.

FIGS. 12A and 12B are schematic views showing a procedure of connecting the upstream and downstream exhaust pipes 31 and 32 in FIG. 10. As shown in FIG. 12A, prior to connection between the upstream and downstream exhaust pipe 31 and 32, the seal ring 33 engages in the ring groove 32*d* formed on the inner peripheral face of the insertion end portion 32*a* of the downstream exhaust pipe 32 and the sleeve 34 is fitted to the insertion end portion 31*a* of the upstream exhaust pipe 31.

Subsequently, as shown in FIG. 12B, the tape 40 is attached to the inner peripheral face of the seal ring 33 engaging in the ring groove 32*d* to allow the seal ring 33 to be fixed to the inner peripheral face of the insertion end portion 32*a* with the diameter of the seal ring 33 expanded. When the tape 40 is attached to the seal ring 33, the taper face 41 is preferably formed between the inner peripheral face of the insertion end portion 32*a* on the upstream end side and the inner peripheral face of the seal ring 33. The tape 40 is combustible or heat-soluble. Further, instead of the tape 40, combustible or heat-soluble bonding agent may be used.

Figure 12C:
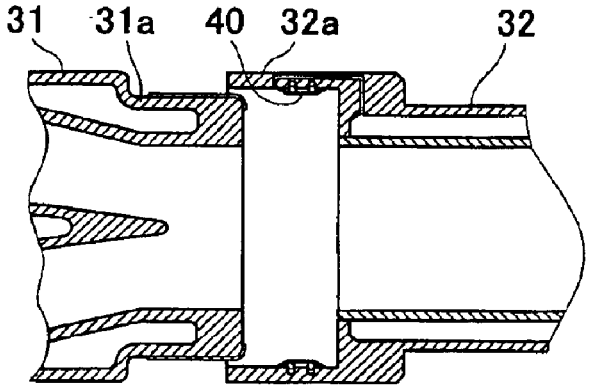
FIG. 12C is a schematic view showing a third configuration in which the upstream exhaust pipe and the downstream exhaust pipe in FIG. 10 are connected to each other.
Figure 12D:
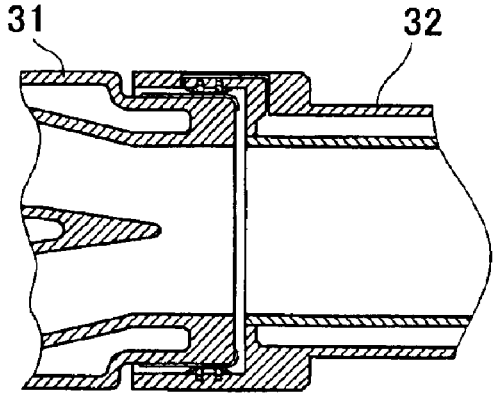
FIG. 12D is a schematic view showing a fourth configuration in which the upstream exhaust pipe and the downstream exhaust pipe in FIG. 10 are connected to each other.

With the seal ring 33 fixed to the inner peripheral face of the insertion end portion 32*a*, the insertion end portion 31*a* of the upstream exhaust pipe 31 is inserted into the insertion end portion 32*a* of the downstream exhaust pipe 32 (FIG. 12C). When the upstream exhaust pipe 31 is inserted into the downstream exhaust pipe 32 a predetermined distance, connection between the upstream and downstream exhaust pipes 31 and 32 is completed.

Embodiment 2

Figure 4:
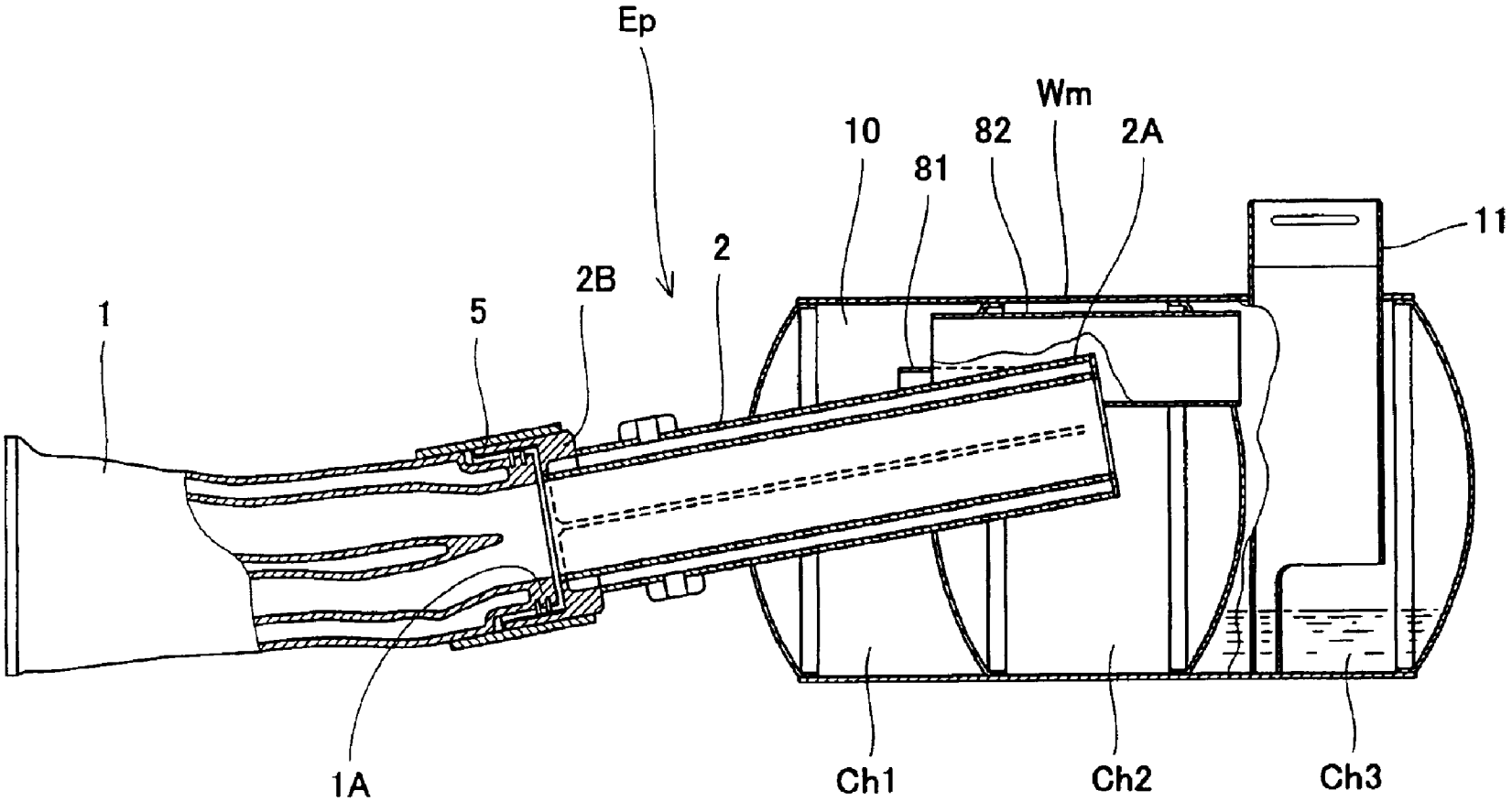
FIG. 4 is a cross-sectional view showing a structure of an exhaust passage including the connecting portion provided in a four-cycle engine of the personal watercraft according to a second embodiment.

As shown in FIG. 4, an alternative example of the exhaust passage Ep is shown, in which the downstream exhaust pipe 2 is comprised of a straight-line pipe having a double-walled structure and is inclined such that its downstream end is higher than its upstream end. In another configuration, the exhaust passage Ep has a structure similar to the exhaust passage Ep in FIG. 1, and the same function and effects are produced. In FIG. 4, the same reference numerals as those in FIG. 1 denote the same or the corresponding parts.

Embodiment 3

Figure 5:
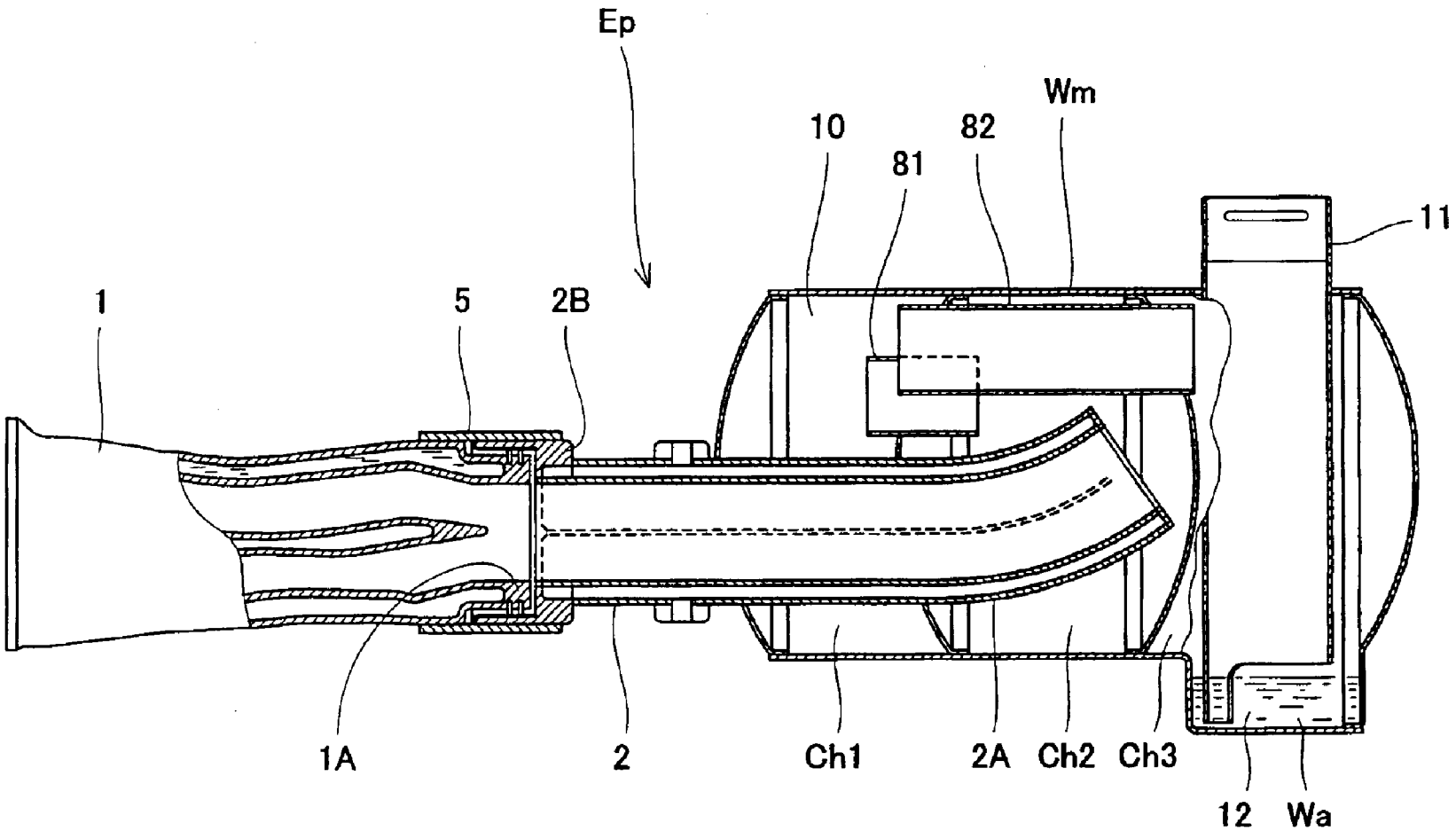
FIG. 5 is a cross-sectional view showing a structure of an exhaust passage including the connecting portion provided in a four-cycle engine mounted in the personal watercraft according to a third embodiment.

As shown in FIG. 5, another alternative example of the exhaust passage Ep is shown, in which a concave portion 12 is formed on a bottom portion of the third chamber Ch3 of the water muffler Wm to reserve water therein. A lower end of the discharge pipe 11 is configured to extend to a position slightly above a bottom face of the concave portion 12, for example, substantially as high as the bottom faces of the first chamber Ch1 and the second chamber Ch2. With this structure, water Wa is reserved in the bottom portion of the third chamber Ch3 and efficiently discharged outside the water muffler Wm. When the watercraft is inverted or almost inverted, the lower end of the discharge pipe 11 (the upper end of the exhaust pipe 1 in an inverted state) is located above the waterline. Therefore, the discharge pipe 11 inhibits water ingress from the downstream end of the exhaust pipe into the third chamber Ch3. In other respects, this embodiment is basically identical to those in FIGS. 1 and 4, and the same function and effects are obtained. In FIG. 5, the same reference numerals as those in FIG. 1 denote the same or corresponding parts.

Embodiment 4

Figure 6:
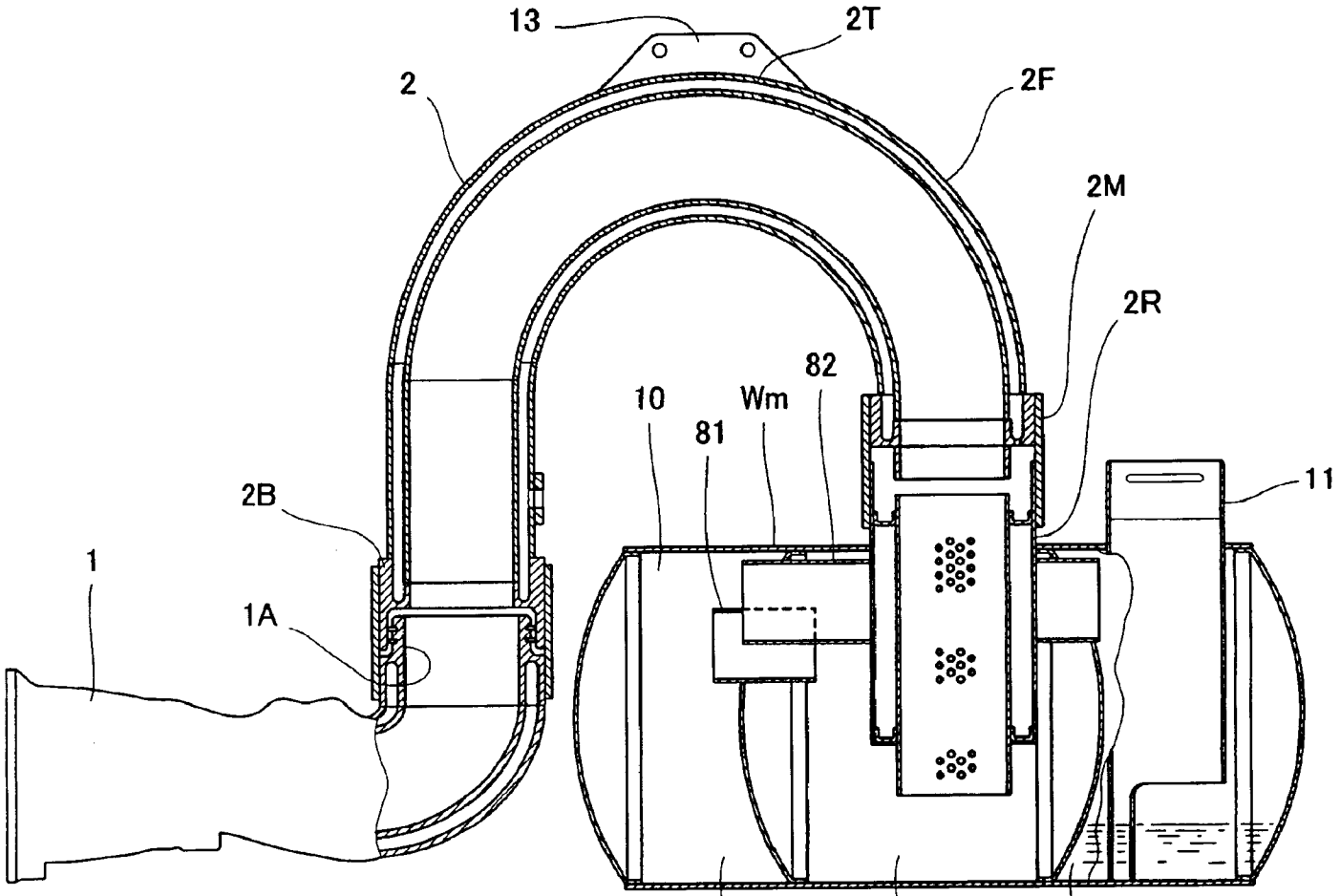
FIG. 6 is a cross-sectional view showing a structure of an exhaust passage including the connecting portion which is provided in a four-cycle engine mounted in the personal watercraft according to a fourth embodiment.

As shown in FIG. 6, another alternative example of the exhaust passage EP is shown, in which the downstream exhaust pipe 2 is comprised of an inverted U-shaped pipe including double-walled structure. Further, the downstream exhaust pipe 2 is comprised of a upstream pipe 2F and a downstream pipe 2R, which are connected to each other through a connecting pipe 2M. In this embodiment, the downstream end portion of the downstream exhaust pipe 2 is accommodated in the second chamber Ch2 so as to extend downwardly from above the water muffler Wm. With this structure, the upstream pipe 2F of the downstream exhaust pipe 2 is upwardly removable. Such a structure facilitates removal of the water muffler Wm from the engine room.

In the structure in FIG. 6, since the downstream end of the downstream pipe 2R of the downstream exhaust pipe 2 is located lower than the water line in a steady state, water ingress into the engine E is inhibited by the downstream exhaust pipe 2 even when the watercraft is inverted or almost inverted. In addition, the length of the exhaust passage Ep is extended for improved exhaust efficiency of the engine E.

In this structure, with a fitting flange member 13 attached to a U-shaped bent portion 2T of the downstream exhaust pipe 2, the upstream pipe 2F of the downstream exhaust pipe 2, may be fixed to a side wall of the engine room of the watercraft.

In the above embodiments, the insertion end portion 1*a* of the upstream exhaust pipe 1 is inserted into the insertion end portion 2*a* of the downstream exhaust pipe 2, this relationship may be reversed.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An exhaust passage configured to discharge an exhaust gas from an engine for driving a propulsion device of a small watercraft, comprising at least:

a first exhaust pipe;

a second exhaust pipe connected to the first exhaust pipe; and a connecting structure configured to connect the first exhaust pipe and the second exhaust pipe to each other, the connecting structure including:

a first tubular insertion end portion provided at a connecting end portion of the first exhaust pipe so as to protrude toward a connecting end portion of the second exhaust pipe;

a second tubular insertion end portion provided at the connecting end portion of the second exhaust pipe so as to accommodate the first tubular insertion end portion of the first exhaust pipe;

a ring groove formed on an outer peripheral face of the first insertion end portion so as to extend circumferentially over the entire first insertion end portion; and a seal ring configured to engage in the ring groove such that the seal ring is biased to increase a diameter so as to allow sealing between an outer peripheral face of the seal ring and an inner peripheral face of the second insertion end portion of the second exhaust pipe.

2. The exhaust passage according to claim 1, wherein the connecting structure further includes a durable sleeve member fitted to an inner peripheral face of the second insertion end portion of the second exhaust pipe so as to be in contact with the outer peripheral face of the seal ring to allow sealing between the sleeve member and the seal ring.

3. The exhaust passage according to claim 2, wherein the sleeve member is tubular, an end portion of the sleeve member on a connecting end side of the second exhaust pipe has an inner diameter that gradually increases toward the connecting end.

4. The exhaust passage according to claim 1, wherein at least one of the first exhaust pipe and the second exhaust pipe has a water passage provided in a wall thereof so as to communicate with the ring groove through an elongate hole to allow cooling water to be supplied into the ring groove.

5. The exhaust passage according to claim 1, wherein the seal ring is made of shape-memory metal.

6. The exhaust passage according to claim 1, wherein an outer peripheral portion continuous with the first insertion end portion of the first exhaust pipe and located on an opposite side of a connecting end of the first insertion end portion, and an outer peripheral portion of the second insertion end portion of the second exhaust pipe have a substantially equal diameter, and wherein the connecting structure further includes a cover sleeve attached to the first exhaust pipe and the second exhaust pipe so as to substantially cover a connecting portion between the first insertion end portion and the second insertion end portion and a portion adjacent to the connecting portion.

7. The exhaust passage according to claim 6, wherein the cover sleeve is comprised of a flexible member, and the cover sleeve is fixed to the first and second exhaust pipes at both ends by using bands.

8. An exhaust passage configured to discharge an exhaust gas from an engine for driving a propulsion device of a small watercraft, comprising at least:

a first exhaust pipe;

a second exhaust pipe connected to the first exhaust pipe; and a connecting structure configured to connect the first exhaust pipe and the second exhaust pipe to each other, the connecting structure including:

a first tubular insertion end portion provided at a connecting end portion of the first exhaust pipe so as to protrude toward a connecting end portion of the second exhaust pipe;

a second tubular insertion end portion provided at the connecting end portion of the second exhaust pipe so as to accommodate the first tubular insertion end portion of the first exhaust pipe;

a ring groove formed on an inner peripheral face of the second insertion end portion so as to extend circumferentially over the entire second insertion end portion; and a seal ring configured to engage in the ring groove such that the seal ring is biased to reduce a diameter so as to allow sealing between an inner peripheral face of the seal ring and an outer peripheral face of the first insertion end portion of the first exhaust pipe.

9. The exhaust passage according to claim 8, wherein the connecting structure further includes a durable sleeve member fitted to an outer peripheral face of the first insertion end portion so as to be in contact with the inner peripheral face of the seal ring to allow sealing between the sleeve member and the seal ring.

10. The exhaust passage according to claim 9, wherein the sleeve member is tubular, and an end portion of the sleeve member on a connecting end side of the first exhaust pipe has an outer diameter that gradually reduces toward the connecting end.

11. The exhaust passage according to claim 8, wherein at least one of the first exhaust pipe and the second exhaust pipe has a water passage provided in a wall thereof so as to communicate with the ring groove through an elongate hole to allow cooling water to be supplied into the ring groove.

12. The exhaust passage according to claim 8, wherein the seal ring is made of shape-memory metal.

13. The exhaust passage according to claim 8, wherein an outer peripheral portion continuous with the first insertion end portion of the first exhaust pipe and located on an opposite side of a connecting end of the first insertion end portion, and an outer peripheral portion of the second insertion end portion of the second exhaust pipe have a substantially equal diameter, and wherein the connecting structure further includes a cover sleeve attached to the first exhaust pipe and the second exhaust pipe so as to substantially cover a connecting portion between the first insertion end portion and the second insertion end portion and a portion adjacent to the connecting portion.

14. The exhaust passage according to claim 13 wherein the cover sleeve is comprised of a flexible member, and the cover sleeve is fixed to the first and second exhaust pipes at both ends by using bands.

15. A method of connecting a first exhaust pipe and a second exhaust pipe, the first exhaust pipe and the second exhaust pipe forming an exhaust passage configured to discharge an exhaust gas from an engine for driving a propulsion device of a small watercraft and having insertion end portions to be connected to each other, the insertion end portion of the first exhaust pipe being configured to be accommodated in the insertion end portion of the second exhaust pipe, and the insertion end portion of the first exhaust pipe and the insertion end portion of the second exhaust pipe being sealed by elastic deformation of a radially and elastically deformable seal ring provided between the insertion end portion of the first exhaust pipe and the insertion end portion of the second exhaust pipe in a radial direction, the method comprising:

forming a ring groove on an outer peripheral face of the insertion end portion of the first exhaust pipe to extend circumferentially over the insertion end portion;

engaging the seal ring in the ring groove and fixing the seal ring to the outer peripheral face of the insertion end portion by using combustible or heat-soluble fixing means so as to inhibit the seal ring from being elastically deformed to increase a diameter;

inserting the insertion end portion of the first exhaust pipe into the insertion end portion of the second exhaust pipe; and heating the insertion end portions of the first and second exhaust pipes.

16. A method of connecting a first exhaust pipe and a second exhaust pipe, the first exhaust pipe and the second exhaust pipe forming an exhaust passage configured to discharge an exhaust gas from an engine for driving a propulsion device of a small watercraft and having insertion end portions to be connected to each other, the insertion end portion of the first exhaust pipe being configured to be accommodated in the insertion end portion of the second exhaust pipe, and the insertion end portion of the first exhaust pipe and the insertion end portion of the second exhaust pipe being sealed by elastic deformation of a radially and elastically deformable seal ring provided between the insertion end portion of the first exhaust pipe and the insertion end portion of the second exhaust pipe in a radial direction, the method comprising:

forming a ring groove on an inner peripheral face of the insertion end portion of the second exhaust pipe to extend circumferentially over the insertion end portion;

engaging the seal ring in the ring groove and fixing the seal ring to the inner peripheral face of the insertion end portion by using combustible or heat-soluble fixing means so as to inhibit the seal ring from being elastically deformed to reduce a diameter;

inserting the insertion end portion of the first exhaust pipe into the insertion end portion of the second exhaust pipe; and heating the insertion end portions of the first and second exhaust pipes.

17. An exhaust passage configured to discharge an exhaust gas from an engine for driving a propulsion device of a small watercraft, comprising:

an exhaust pipe partially forming the exhaust passage; and a water muffler connected to the exhaust pipe;

wherein a downstream end portion of the exhaust pipe is accommodated in the water muffler such that its downstream end is higher than an upstream portion of the exhaust pipe within the water muffler;

wherein the downstream end of the exhaust pipe is located in the vicinity of a center line in a vertical direction of the water muffler;

wherein the exhaust pipe is provided with a waterjacket on an outer peripheral portion of the exhaust pipe, and a water supply port is provided at the downstream end of the exhaust pipe to supply water from the water jacket into the exhaust gas discharged from the downstream end of the exhaust pipe; and wherein the water jacket is provided so as to cover the exhaust pipe and to extend substantially to a downstream end of the exhaust pipe and has an end wall configured to extend radially outward from the exhaust pipe, and a water supply port is provided on the end wall and configured to supply water to the exhaust gas discharged from the downstream end of the exhaust pipe.

18. The exhaust passage according to claim 17, wherein the water supply port is provided at an upper end portion of the downstream end of the exhaust pipe; and wherein an end face at the downstream end of the exhaust pipe is inclined to face substantially upward, and the water supply port is formed at an upper end portion of the end wall.

19. The exhaust passage according to claim 17, wherein the water supply port is provided at an upper end portion of the downstream end of the exhaust pipe; and wherein an end face at the downstream end of the exhaust pipe faces downward and is configured to be vertical or inclined such that a lower end of the exhaust pipe is closer to an upstream side than an upper end of the exhaust pipe, and the water supply port is configured to protrude toward a downstream side more greatly than the lower end of the exhaust pipe.

20. An exhaust passage configured to discharge an exhaust gas from an engine for driving a propulsion device of a small watercraft, comprising:

an exhaust pipe partially forming the exhaust passage; and a water muffler connected to the exhaust pipe, wherein a downstream end portion of the exhaust pipe is accommodated in the water muffler such that its downstream end is higher than an upstream portion of the exhaust pipe within the water muffler;

wherein the downstream end of the exhaust pipe is located in the vicinity of a center line in a vertical direction of the water muffler;

wherein the exhaust pipe is provided with a water jacket on an outer peripheral portion of the exhaust pipe, and a water supply port is provided at the downstream end of the exhaust pipe to supply water from the water jacket into the exhaust gas discharged from the downstream end of the exhaust pipe; and wherein the water jacket is internally provided with a separating wall that defines an upper water jacket and a lower water jacket.

21. The exhaust passage according to claim 20, wherein a communicating port is provided on the separating wall at the downstream end of the exhaust pipe to allow the lower water jacket and the upper water jacket to communicate with each other.

22. The exhaust passage according to claim 21, wherein the lower water jacket is provided with a cooling water supply port to supply cooling water into the water jacket, and the upper water jacket is provided with a discharge port to discharge the cooling water from the water jacket.

23. A water muffler in which a downstream end portion of an exhaust pipe partially forming an exhaust passage configured to discharge an exhaust gas from an engine for driving a propulsion device of a small watercraft is accommodated, the water muffler comprising:

an exhaust chamber configured to discharge the exhaust gas inflowing from the engine outside the water muffler, the exhaust chamber being provided with a downwardly recessed concave portion on a bottom face thereof; and a discharge pipe extending upwardly from the concave portion of the exhaust chamber such that its upper end extends to an outside of the water muffler and its lower end opens into the downwardly recessed concave portion.

24. The water muffler according to claim 23, wherein the water muffler is configured to have a first chamber, a second chamber, and a third chamber which are arranged in-line in this order from an upstream end side of the exhaust pipe, a downstream end of the exhaust pipe is located within the second chamber, and the exhaust chamber is the third chamber.

25. The water muffler of claim 23, wherein a step-like cut portion is formed at the lower end of the discharge pipe, and located in the concave portion.

26. An exhaust passage configured to discharge an exhaust gas from an engine for driving a propulsion device of a small watercraft, comprising:

an exhaust pipe partially forming the exhaust passage; and a water muffler connected to the exhaust pipe;

wherein a downstream end portion of the exhaust pipe is accommodated in the water muffler such that its downstream end is higher than an upstream portion of the exhaust pipe within the water muffler;

wherein the downstream end of the exhaust pipe is located in the vicinity of a center line in a vertical direction of the water muffler;

wherein the exhaust pipe is provided with a water jacket on an outer peripheral portion of the exhaust pipe, and a water supply port is provided at the downstream end of the exhaust pipe to supply water from the water jacket into the exhaust gas discharged from the downstream end of the exhaust pipe;

wherein the water supply port is provided at an upper end portion of the downstream end of the exhaust pipe; and wherein an end face at the downstream end of the exhaust pipe is configured to be vertical or inclined such that a lower end of the exhaust pipe is closer to an upstream side than an upper end of the exhaust pipe, and the Water supply port is configured to protrude toward a downstream side more greatly than the lower end of the exhaust pipe.

* * * * *